1-27-76 OR 3,934,466

United States Patent [19]

Curry

[11] 3,934,466

[45] Jan. 27, 1976

[54] RESISTANCE SENSING FREE-POINT TOOL

[75] Inventor: Willie A. Curry, Houma, La.

[73] Assignee: Jude Thaddeus Fanguy, Houma, La.; a part interest

[22] Filed: May 16, 1974

[21] Appl. No.: 470,558

[52] U.S. Cl. ..... 73/151

[51] Int. Cl.[2] ..... E21B 47/024

[58] Field of Search ..... 73/151, 152; 166/255, 250

[56] References Cited

UNITED STATES PATENTS

| | | | |
|---|---|---|---|
| 2,530,309 | 11/1950 | Martin | 73/151 |
| 2,534,632 | 12/1950 | Smith | 73/152 |
| 2,851,880 | 9/1958 | Fiedler | 73/141 R |
| 3,670,566 | 6/1972 | Basham et al. | 73/151 |
| 3,762,218 | 10/1973 | Davis | 73/151 |

*Primary Examiner*—Richard C. Queisser
*Assistant Examiner*—Marcus S. Rasco
*Attorney, Agent, or Firm*—Robert G. McMorrow

[57] ABSTRACT

An improved free-point measuring system for indicating whether a pipe in a borehole is free or stuck at various locations within the borehole is disclosed. The system employs an improved free-point tool in which is mounted a variable resistor having a wiper arm adapted to be displaced with a movement of the pipe. Displacement of the wiper arm causes a change in the resistance of the variable resistor, and this change is detected by a surface unit provided with balancing and calibrating resistors.

1 Claim, 2 Drawing Figures

RESISTANCE SENSING FREE-POINT TOOL

BACKGROUND OF THE INVENTION

1. Field of the Invention

The present invention generally relates to free-point indicator apparatus for locating the point at which a pipe is stuck in a borehole, and more particularly to an improved free-point tool operating on direct current and employing only resistance measurements.

2. Description of the Prior Art

There are a number of applications such as, for example, in the drilling of wells or the like when a pipe becomes stuck in a borehole and it becomes desirable to ascertain the exact location in the borehole where the pipe is stuck. Measuring instruments known as free-point tools or indicators are in common use for this purpose. One such free-point indicator is disclosed in U.S. Pat. No. 3,004,427 which employs a variable inductance supplied with an alternating current. The variable inductance has a magnetic core divided into two portions which are separated by movement of the pipe when tension is applied, resulting in a change in inductance which can be measured at the surface. Other such free-point indicators use oscillators and determine by a charge of frequency whether or not a pipe is free or stuck.

While the prior art free-point indicators have been used with varying degrees of success in the past, the accuracy with which these instruments measure is often affected by the type, weight and magnetic properties of the metal of the pipe and, in some cases, by the earth's magnetic field. Furthermore, the prior art free-point indicators are typically rather complex devices requiring multiconductor electrical cables and expensive electronic circuitry.

SUMMARY OF THE INVENTION

It is therefore an object of the present invention to provide an improved free-point tool in which the accuracy of the instrument is unaffected by the physical properties of the pipe.

It is another object of the invention to provide an accurate free-point measuring system of simple construction employing direct current measurements.

The foregoing and other objects of the invention are attained by providing an improved free-point tool in which is mounted a variable resistor having a wiper arm adapted to be displaced when the pipe is stretched as by pulling from the surface. Thus, if the pipe is free, the wiper arm will be displaced thereby causing a change in resistance of the variable resistor. Such a change in resistance is detected by a surface unit which includes balancing and calibrating resistors for balancing out the resistance of the cable extending to the variable resistor in the tool and for calibrating a meter in the surface unit. The important feature of the system is that it operates on direct current and employs only resistance measurements. As a result, the accuracy of the measurements made by the improved resistance-sensing free-point tool according to the invention is unaffected by the physical properties of the pipe or of the earth's magnetic field. Moreover, the simplicity of the construction of the tool constructed in accordance with the teachings of the invention requiring only a single conductor cable running to the variable resistor and requiring only the measurement of the difference of D.C. resistance greatly reduces the expense of manufacture.

BRIEF DESCRIPTION OF THE DRAWINGS

The specific nature of the invention, as well as other objects, aspects, uses and advantages thereof, will clearly appear from the following description and from the accompanying drawings, in which.

DESCRIPTION OF THE PREFERRED EMBODIMENT

Figure 1:
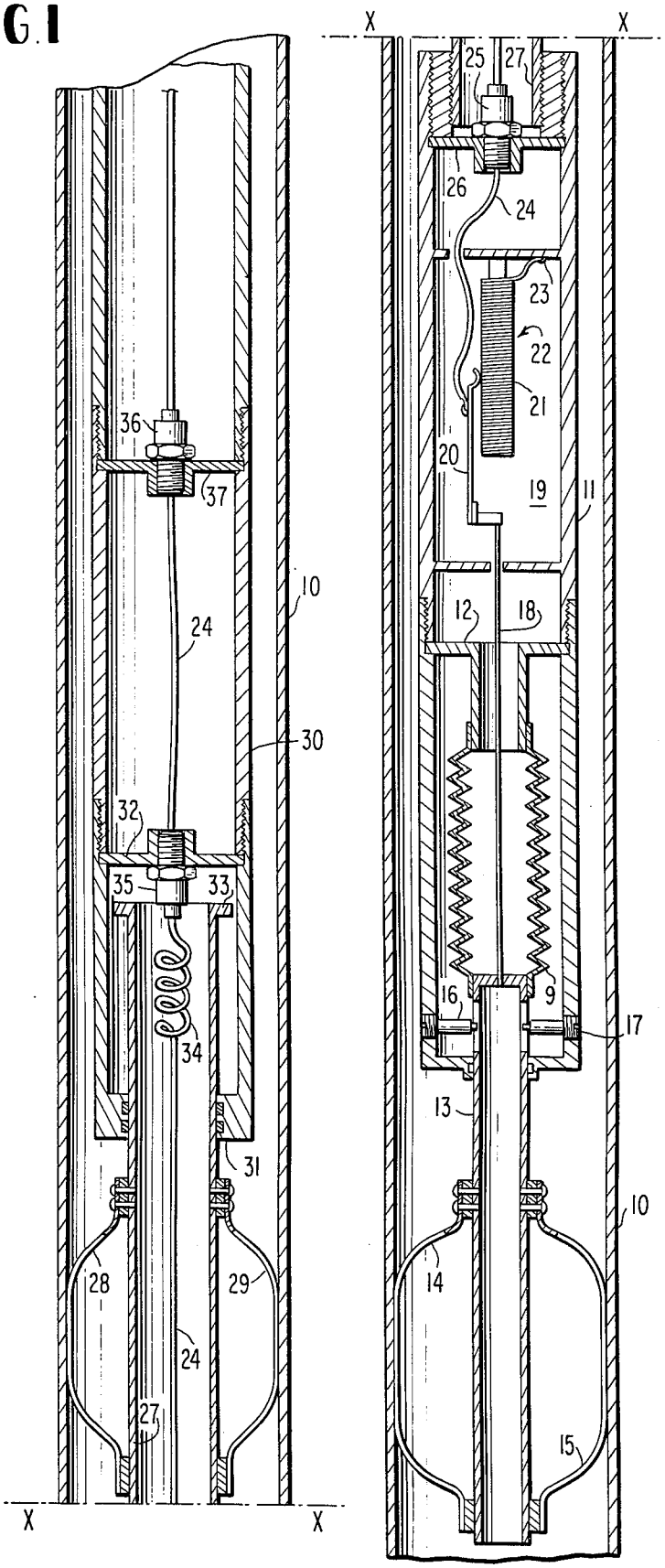
FIG. 1 is a section view through a pipe in a borehole illustrating the resistance-sensing free-point tool according to the invention.

Referring now to the drawings, and more particularly to FIG. 1 thereof, the pipe having a stuck section the location of which is to be measured is generally indicated by the reference numeral 10. The free-point tool which is lowered into the pipe comprises a first outer casing 11 which is divided approximately in half by a closure plate 12 having a cylindrical tube projecting downwardly therethrough. The lower end of casing 11 is provided with a flange which slidably engages a rod or tubular member 13. The upper end of the rod 13 is connected to the downwardly projecting tube in plate 12 by a flexible rubber bellows or boot 9. Thus, the bellows 9, the top of rod 13, and the portion of casing 11 above plate 12 define a chamber 19 which is preferably oil filled. The volume of this chamber remains constant with longitudinal displacement of the rod 13 by the horizontal expansion and contraction of bellows 9. The rod 13 carries conventionl friction bow springs 14 and 15 which engage the inner surface of pipe 10 and, while rod 13 is disposed to slide in and out of casing 11, this longitudinal movement is limited by limit screws 16 and 17.

A wiper rod 18 is threaded into the end of rod 13 that projects within the casing 11. The wiper rod 18 extends up through casing 11 to a chamber 19 and is mechanically attached to, but is electrically insulated from, the wiper arm 20 of potentiometer 22. The winding 21 of the potentiometer 22 is mechanically fixed within chamber 19 and movable therewith. One end of the winding 21 is grounded to the casing at 23, and the other end is not connected electrically. Thus, the potentiometer 22 is connected as a variable resistor.

An electrical connection to the wiper arm 20 of potentiometer 22 is made by a wire 24 which extends through the insulator 25 in end plate 26. The end plate 26 seals the upper end of casing 11 and is held in place by a tubular member 27 which is threaded into the upper end of casing 11 and abuts end plate 26. The tubular member 27 extends upwardly from the casing 11 and carries conventional friction bow springs 28 and 29, similar to bow springs 14 and 15. The upper end of tubular member 27 extends into a second casing 30 through a flange 31. Casing 30 is divided into two chambers by an integral baffle or plate 32. Plate 32 thus defines the upper limit of travel of the tubular member 27 within casing 30. The upper end of tubular member 27 is provided with an annular flange 33 which operates as a stop which, in cooperation with the flange 31, defines the lower limit of travel of the tubular member within the casing 30. The structure just defined including the tubular member 27, the flange 31, the plate 32, and the annular flange 33 comprise a slack joint for the free-point tool.

Wire 24 is coiled within the tubular member 27 at 34 to account for movement of the slack joint. The wire 24 passes through an insulator 35 in plate 32 and through another insulator 36 in plate 37 which seals the upper end of the casing 30. The upper end of casing 30 is adapted by means (not shown), such as a cable, for raising and lowering the free-point tool within the pipe 10.

Figure 2:
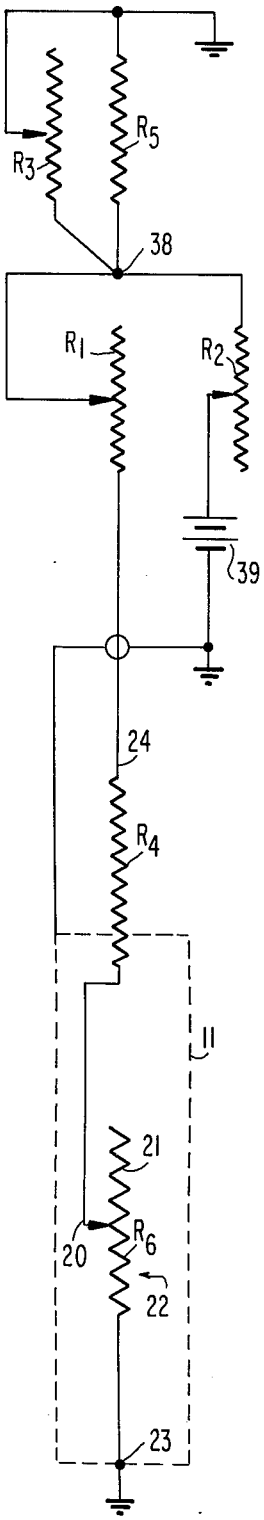
FIG. 2 is a schematic diagram showing the circuits of the surface sensing unit in combination with the variable resistor in the free-point measuring system of the invention.

Referring now to FIG. 2 of the drawings, there is shown a schematic diagram of the free-point tool in combination with the surface sensing unit. The surface sensing unit comprises a potentiometr $R_1$ having its wiper arm connected to a node 38. Two other potentiometers $R_2$ and $R_3$ have one end of their windings also connected to node 38. All three of these potentiometers, $R_1$, $R_2$ and $R_3$, are connected as variable resistances by reason of the fact that only one end of their respective windings are connected in the circuit. A read-out meter, such as an ammeter, is represented by a fixed resistance $R_5$ having one end connected to the node at 38 and the other end connected to ground. The wiper arm of potentiometer $R_3$ is also connected to ground so that $R_3$ acts as a variable resistance in parallel with the meter, $R_5$.

The wiper arm of potentiometer $R_2$ is connected to one terminal of a power supply preferably a battery 39, the other terminal of which is referenced to ground. One end of the winding of the potentiometer $R_1$ is connected to the wire 24, the line resistance of which is represented by the fixed resistor $R_4$. The other end of wire 24, of course, is connected to the variable resistor $R_6$ consisting of the potentiometer 22 in the free-point tool. The dotted line enclosing the potentiometer 22 schematically represents the casing, 11 for example, of the free-point tool which is grounded. Therefore, there is a common ground between one end of the winding 21 of the potentiometer 22 and the reference ground in the surface sensing unit which is provided by the cable, for example, which is used to raise and lower the free-point tool within the pipe.

In operation, the free-point tool according to the invention is anchored to the pipe by the bow springs 14, 15 and 28, 29. The slack joint comprising the tubular member 27, the flange 31, the plate 32, and the annular flange 33 has a free travel space of, for example, 36 inches and is built for free travel. When the operator picks up on the free-point tool by means of a wire cable (not shown) from the surface, the slack joint will open if it is closed. When the slack joint is fully open, the free-point tool will then move up within the pipe 10. On the other hand when the slack joint is fully closed, the free-point tool will move downward under the combined weight of the upper and lower casings 30 and 11, respectively, which is sufficient to overcome the friction of the bow springs 14, 15, 28, and 29. If the slack joint is at an intermediate condition between fully open and fully closed, i.e. the upper casing 30 is supported by the cable to the surface, the lower casing 11 and tubular member 27 are supported within the pipe 10 by the bow springs 14, 15, 28, and 29.

To check if the free-point tool is working, the operator picks up on the supporting cable from the surface. The sensing unit will not move, of course, until the slack joint is fully open. However, once the slack joint is fully open, the tubular member 27, its bow springs 28 and 29, and casing 11 will move, but not rod 13 and its bow springs 14 and 15. As a result, the winding 21 will be moved with respect to wiper arm 20 of potentiometer 22, and this movement will be sensed on the surface.

Once the operator determines that the tool is working properly, he sets the slack joint at midtravel by lowering the supporting cable, say 18 inches or so. The distance of travel of the slack joint may typically be measured by an odometer driven by a pulley over which the supporting cable passes. Then, the only movement of the variable resistor consisting of potentiometer 22 occurs when the pipe 10 is stretched as by pulling on the pipe from the surface. Any change of resistance of the variable resistor comprising the potentiometer 22 is noted on the surface sensing unit. When the pipe is free at the location of the free-point tool, the pipe will stretch and move the winding 21 with respect to the wiper arm 20 causing a change in resistance in the variable resistor. By this means, the operator is able to tell that the pipe is free at that particular point where the free-point tool is located. On the other hand, when the pipe is stuck, there will be no stretch of the pipe due to a pulling of it at the surface and, as a result, there will be no change in resistance due to the fact that there will be no relative movement between the winding 21 and the wiper arm 20 of the potentiometer 22. The surface unit senses no change in resistance telling the operator that the pipe is stuck at the location of the free-point unit.

By adjusting the potentiometers $R_1$ and $R_2$ in the surface unit, the meter $R_5$ will see the total amount of resistance of $R_4$ and $R_6$. When the meter sees the total amount of resistance $R_4$ and $R_6$, the meter will have a fixed amount of movement. This amount of meter movement is the line balance. The point on the meter where the line balance ends is the free-point zero. From the free-point zero on the meter to full calibrated reading is the range or amount of free points when the pipe is stretched by pulling. Different weight and sizes of pipes have different amounts of stretch. By adjusting potentiometer R3 on the surface unit, the operator can adjust the meter to read a range from, for example, zero to 100 points according to the size and weight of the pipe. When the line resistance R4 is balanced to the free-point zero on the meter, the only resistance the meter sees then is the amount of movement of the wiper 20 on the winding 21 of the potentiometer 22 comprising the variable resistor R6 in the free-point tool.

As a particular example of the procedure used in adjusting the surface unit, suppose the line 24 (R4) has a resistance of 100 ohms. This resistance is in series with R6, R1 and the parallel connection of R3 and R5. The meter R5 having a fixed resistance may be considered as a load for the circuit. The meter is calibrated to read a change in R6 over a part of the meter face. If the line 24 (R4) is other than the 100 ohms for which the meter was calibrated, adjustment can be made by adjusting R1. R2 acts as a sensitivity control for the meter, and R3 in shunt with the meter provides a safety factor for the meter as well as making the meter a variable resistance meter permitting further calibration. By adjusting R1, R2 and R3 the meter can be adjusted to the free-point zero on the meter face. Thereafter, the only change in resistance which will reslt in a deflection of the meter movement will be a change in the resistance of R6.

The slack joint in the free-point tool itself serves as a means for calibrating a tool. By opening and closing the slack joint, the operator can tell that the tool is working or not working as earlier described. The tool is set to a place in the pipe that is thought to be free, and by pulling on the pipe from the surface the operator can calibrate the tool at this point if, indeed, the pipe is free at this point. If the pipe in fact is not free, the operator keeps trying until a free point in the pipe is found and then calibrates the tool. To calibrate the tool, the slack joint may be fully opened by raising the supporting cable causing the winding 21 of potentiometer 22 to move relative to wiper arm 20 to change the resistance of R and hence the resistance of the circuit. Alternatively, the slack joint may be fully closed by lowering the supporting cable resulting in an opposite change in resistance. The changes in resistance thus observed can be recorded at the surface as the free point units. When the pipe is found to be free at one point, the operator selects another place in the pipe and applies the same method to find if the pipe is stuck or free. By using this method the operator can find the deepest point where the pipe is free.

The amount of movement between the winding 21 and the wiper arm 20 of the potentiometer 22 depends on the size of the holes in the casing 11 of the tool where the limit screws 16 and 17 are threaded and the size of the limit screws themselves. The limit screws serve as a means of controlling the total amount of relative movement of the winding 21 and the wiper arm 20. Thus, the amount of the change in resistance of R6 from low to high resistance is limited. The total travel of the wiper arm 20 with respect to the winding 21 may be, for example, 1 inch. Assuming the total resistance of R6 to be 1000 ohms, when the wiper 20 is moved 0.001 inch, the change in resistance will be 1 ohm; if R6 is 10,000 ohms, the change will be 10 ohms, and so forth. The choice of the resistance of R6 depends on the sensitivity of the surface sensing unit.

It will be appreciated from the foregoing, that the free-point tool according to the invention is characterized by many advantages over prior art free-point tools. More specifically, the sensing unit in the system according to the invention does not use any kind or form of a frequency-generating unit and thereby obviating the necessity of an oscillator which is characteristic of most prior art free-point indicator systems. The sensing unit measures only a difference in D.C. resistance; therefore, the size, weight and composition of the pipe has no effect on the free-point measurement. The embodiment shown is, of course, only exemplary and various modifications can be made in construction and arrangement within the scope of the invention as defined in the appended claims.

What is claimed is:

1. A free-point indicator system for determining the elevations of stuck and free portions of a pipe in a borehole, comprising:

a. a free-point indicator tool including i. an upper section and a lower section mounted for longitudinal movement relative to each other, ii. frictional means on each of said sections for frictionally engaging the inside of a pipe to thereby cause said upper section to move upwardly relative to said lower section upon a stretching of the pipe, iii. a variable resistance having a winding and a wiper arm, one of said winding or wiper arm being mechanically attached to said upper section for movement therewith and the other of said wiper arm or winding being mechanically attached to said lower section and fixed thereto, and iv. slack joint means slidably connected to said upper section for limited relative movement therebetween, said slack joint means having fully open and fully closed positions and intermediate positions, said free-point indicator system being capable of being raised when said slack joint is in its fully open position or of being lowered when said slack joint is in its fully closed position but remaining stationary when said slack joint is in an intermediate position, b. a single conductor wire line electrically connected to said wiper arm and extending to the surface, and c. surface sensing means connected to said single conductor wire line for measuring the relative change in resistance due to the relative movement of said winding with respect to said wiper arm, said surface measuring means including, i. an indicating meter, ii. a D. C. power supply, said indicating meter and said D. C. power supply being connected with said single conductor wire line to a common node and electrically referenced to ground and iii. balancing and calibrating means connected to said single conductor wire, said indicating meter and said D. C. power supply for balancing out the resistance of said single conductor wire and adjusting the free-point zero and range of said indicating meter, said balancing and calibrating means including a first variable resistance connected in series between said single conductor wire line and said common node, a second variable resistance connected in shunt with said indicating meter, and a third variable resistance connected in series between said D. C. power supply and said common node, said first variable resistance serving to balance out the resistance of said single wire line, said second variable resistance serving to adjust the range of said indicating meter, and said third variable resistance serving to adjust the sensitivity of said surface measuring means.

* * * * *